US011693344B2

(12) United States Patent
Kinoshita et al.

(10) Patent No.: US 11,693,344 B2
(45) Date of Patent: Jul. 4, 2023

(54) FIXING BELT UNIT AND FIXING DEVICE

(71) Applicant: CANON KABUSHIKI KAISHA, Tokyo (JP)

(72) Inventors: Takeshi Kinoshita, Chiba (JP); Junji Ishikawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 17/544,860

(22) Filed: Dec. 7, 2021

(65) Prior Publication Data

US 2022/0091547 A1 Mar. 24, 2022

Related U.S. Application Data

(63) Continuation of application No. PCT/JP2020/025930, filed on Jun. 25, 2020.

(30) Foreign Application Priority Data

Jun. 28, 2019 (JP) ..... 2019-121149
Jun. 28, 2019 (JP) ..... 2019-121155

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01); *G03G 2215/2035* (2013.01)

(58) Field of Classification Search
USPC ..... 399/385
See application file for complete search history.

(56) References Cited

U.S. PATENT DOCUMENTS 9,316,970 B2 4/2016 Kinoshita ..... G03G 15/2042
9,411,279 B2 8/2016 Ishikawa ..... G03G 15/2053
(Continued)

FOREIGN PATENT DOCUMENTS

JP 2000-340337 12/2000
JP 2010-128452 6/2010
(Continued)

OTHER PUBLICATIONS

International Search Report and Written Opinion in counterpart International Application No. PCT/JP2020/025930, with English translation.

*Primary Examiner* — Quana Grainger
(74) *Attorney, Agent, or Firm* — Venable LLP

(57) ABSTRACT

A heating efficiency 600 includes a substrate 610 and a plurality of heat generating elements 523*a* to 623*f* which are provided on both surfaces of the substrate 610 and which generate heat, and heats a fixing belt in contact with an inner peripheral surface of the fixing belt. The plurality of heat generating elements 623*a* to 623*f* are different from each other in length with respect to a widthwise direction, and at least three of the heat generating elements are provided on a front surface of the substrate 610 which is a side where the heater 600 contacts the inner peripheral surface of the fixing belt 600, and at least one of the heat generating elements is provided on a back surface. A longest heat generating element 623*b*, in length with respect to the widthwise direction, of the plurality of heat generating elements 623*a*-623*f* is provided on the front surface. Further, as regards the heat generating elements 523*a*-623*c* provided on the front surface, with respect to a rotational direction of the fixing belt, the longest heat generating element 623*b* in length with respect to the widthwise direction is disposed between the
(Continued)

heat generating element 623*a* and the heat generating element 623*c*.

9 Claims, 6 Drawing Sheets

(56) References Cited

U.S. PATENT DOCUMENTS

| | | | | |
|---|---|---|---|---|
| 10,444,677 | B2 | 10/2019 | Ishikawa et al. | G03G 15/80 |
| 2016/0018764 | A1 | 1/2016 | Takagi et al. | G03G 15/205 |
| 2017/0192379 | A1 | 7/2017 | Cao et al. | G03G 15/2039 |
| 2019/0171136 | A1 | 6/2019 | Iwasaki et al. | G03G 15/205 |

FOREIGN PATENT DOCUMENTS

| | | | | | |
|---|---|---|---|---|---|
| JP | 2013-235181 | | | 11/2013 | |
| JP | 2016-024321 | | | 2/2016 | |
| JP | 2019-101251 | | | 6/2019 | |
| JP | 2021006874 | A | * | 1/2021 | |
| WO | WO-2020262707 | A1 | * | 12/2020 | G03G 15/2053 |

* cited by examiner

FIXING BELT UNIT AND FIXING DEVICE

This application is a continuation of International Application No. PCT/JP2020/025930 filed Jun. 25, 2020, currently pending; and claims priority under 35 U.S.C. § 119 to Japanese Patent Application No. 2019-121149 filed in Japan on Jun. 28, 2019 and to Japanese Patent Application No. 2019-121155 filed in Japan on Jun. 28, 2019; the content of all of which are incorporated by reference herein.

TECHNICAL FIELD

The present invention relates to a fixing belt unit used in a fixing device for fixing a toner image on a recording material, and a fixing device including the fixing belt unit.

BACKGROUND ART

As the fixing device, a constitution in which a fixing belt for heating the recording material is heated by a heater has been conventionally known. Further, as the heater, a constitution in which heat generating elements different in length from each other are disposed on both surfaces of a substrate and in which heating in conformity to a size of the recording material is capable of being made has been proposed (Japanese Laid-Open Patent Application 2016-24321).

Problem to be Solved by the Invention

In a constitution in which three or more heat generating elements different in length from each other are provided on one surface of the substrate and in which energization is carried out to a selected heat generating element, in the case where a longest heat generating element in length is provided on one side in a recording material direction, the following problem arises. The longest heat generating element in length is largest in heat generating quantity. As a result, in the case where energization is carried out to only this longest heat generating element, a temperature difference between one end side and the other end side of the substrate with respect to the feeding direction becomes large, so that there is a liability that distortion of the substrate occurs. For that reason, a constitution in which the distortion of substrate caused due to the energization to the longest heat generating element is reduced has been desired.

Effect of the Invention

According to the present invention, it is possible to reduce the distortion of the substrate caused due to the energization to the longest heat generating element.

EMBODIMENTS FOR CARRYING OUT THE INVENTION

First Embodiment

A first embodiment will be described using FIG. 1 to FIG. 5. First, a schematic structure of an image forming apparatus of this embodiment will be described using FIG. 1.

[Image Forming Apparatus]

Figure 1:
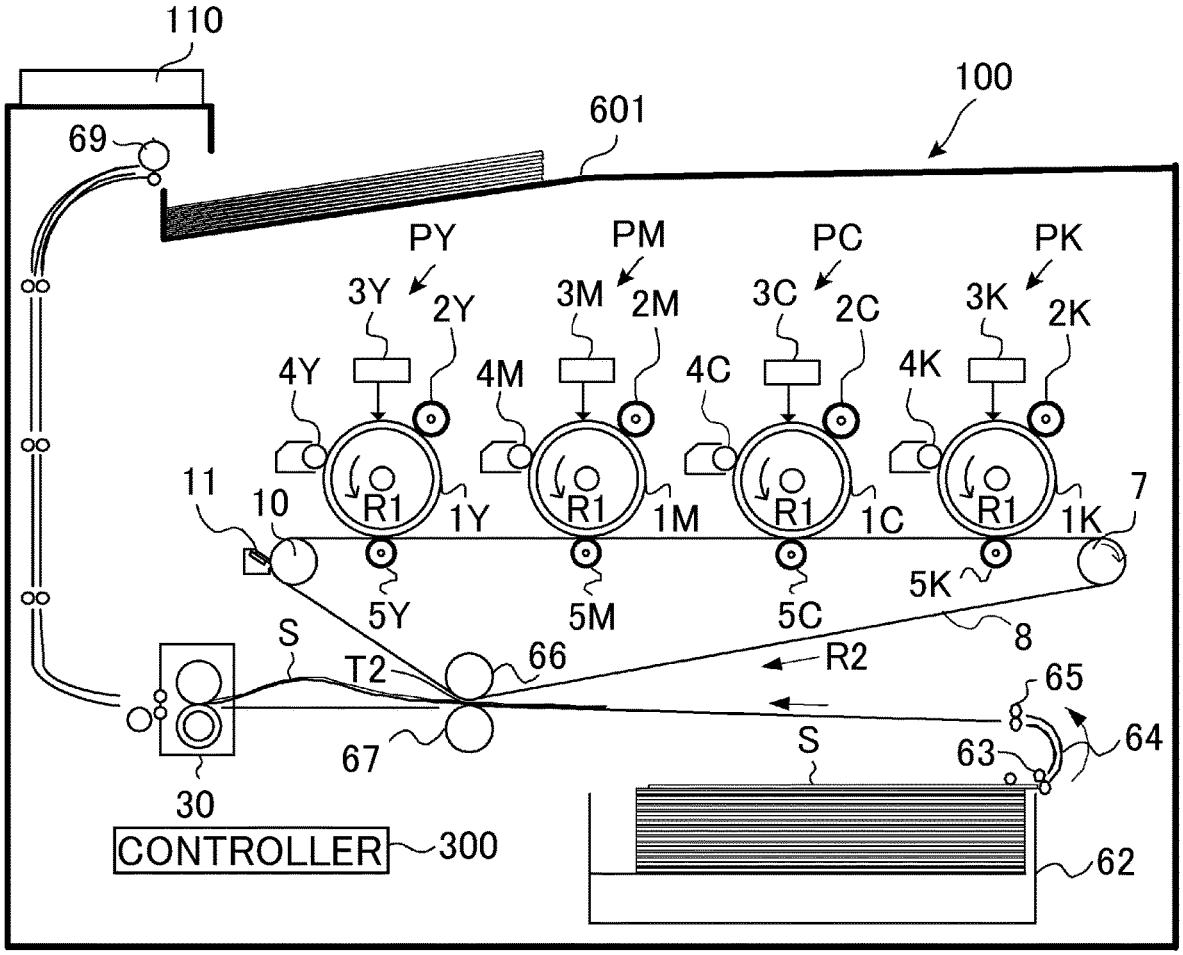
FIG. 1 is a schematic structural sectional view of an image forming apparatus according to a first embodiment.

An image forming apparatus 100 shown in FIG. 1 is a full-color printer of an electrophotographic type including image forming portions PY, PM, PC and PK for four colors (yellow, magenta, cyan and black) in an apparatus main assembly. In this embodiment, an intermediary tandem type in which the image forming portions PY, PM, PC and PK are disposed along a rotational direction of an intermediary transfer belt described later. The image forming apparatus 100 forms a toner image (image) on a recording material S depending on an image signal from an original reading device (not shown) connected to the apparatus main assembly or from a host device such as a personal computer communicatably connected to the apparatus main assembly. As the recording material S, a sheet material, such as a sheet, a plastic film, or a cloth can be cited.

First, a recording material feeding process of the image forming apparatus 100 will be described. The recording materials S are accommodated in the form such that the recording materials S are stacked in a cassette 62, and are fed one by one to a feeding path 64 in synchronism with an image forming timing, by a feeding roller 63. Further, recording materials S stacked on an unshown manual feeding tray may also be fed one by one to the feeding path 64. When the recording material S is fed to a registration roller 65 disposed in an intermediary part of the feeding path 64, the recording material S is sent to a secondary portion T2 after being subjected to oblique movement correction and timing correction thereof by the registration roller 65. The secondary transfer portion T2 is, as described later, a transfer nip formed by a portion of the intermediary transfer belt 8, stretched by an inner secondary transfer roller 66, and by an outer secondary transfer roller 67. At the secondary transfer portion T2, a secondary transfer voltage is applied to the inner secondary transfer roller 66, so that the toner image is secondary transferred from the intermediary transfer belt 8 onto the recording material S.

Relative to the above-described feeding process of the recording material S to the secondary transfer portion T2, a forming process of the toner image sent to the secondary transfer portion T2 at a similar timing will be described. First, the image forming portions PY-PK will be described. However, the image forming portions PY-PK are constituted substantially identically except that colors of toners used in developing devices 4Y, 4M, 4C and 4K are different from each other. Therefore, in the following, as a representative, the image forming portion PY for yellow will be described as an example, and other image forming portions PM, PC and PK will be omitted from description.

The image forming portion PY is principally constituted by a photosensitive drum 1Y, a charging device 2Y, an exposure device 3Y, the developing device 4Y, and the like. A surface of the photosensitive drum (cylindrical photosensitive member) 1Y as an image bearing member rotationally driven is electrically charged uniformly in advance by the charging device 2Y, and thereafter, an electrostatic latent image is formed by the exposure device 3 driven on the basis of a signal of image information. Next, the electrostatic latent image formed on the photosensitive drum 1Y is developed with the toner by the developing device 4Y, and is visualized as the toner image. Thereafter, a predetermined pressure and a predetermined primary transfer bias are applied by a primary transfer roller 5Y disposed opposed to the photosensitive drum 1Y while sandwiching the intermediary transfer belt 8 therebetween, so that the toner image formed on the photosensitive drum 1Y is primary-transferred onto the intermediary transfer belt 8. Transfer residual toner slightly remaining on the photosensitive drum 1Y after the primary transfer is removed by an unshown cleaning blade or the like, and the photosensitive drum 1Y is prepared for a subsequent image forming process.

The intermediary transfer belt 8 as an intermediary transfer member is stretched by a tension roller 10, the inner secondary transfer roller 66, and a driving roller 7. Then, the intermediary transfer belt 8 is driven by the driving roller 7 so as to move toward an arrow R2 direction in the figure. The image forming portions for the respective colors processed by the above-described image forming portions PY-PK are carried out at timings when the toner image is sequentially superposed on the toner image primary-transferred on the intermediary transfer belt 8 and for an upstream color with respect to a movement direction. As a result, finally, a full-color toner image is formed on the intermediary transfer belt 8 and is fed to the secondary transfer portion T2. Incidentally, transfer residual toner after passing through the secondary transfer portion is removed from the intermediary transfer belt 8 by a transfer cleaner device 11.

By the feeding process and the image forming processes each described above, the toner image is secondary-transferred from the intermediary transfer belt 8 onto the recording material S. Thereafter, the recording material S is fed toward a fixing device 30 and is pressed and heated by the fixing device 30, whereby the toner image is melted and fixed on the recording material S. The recording material S on which the toner image is thus fixed is discharged onto a discharge tray 601 by a discharging roller 69. Incidentally, the image forming apparatus 100 includes a controller 300 for carrying out various pieces of control such as the above-described image forming operations and the like. Further, the above-described series of image forming operations are controlled by the controller 300 in accordance with respective input signal via an operating portion 110 on an upper surface of the apparatus main assembly or via a network.

[Fixing Device]

Next, the fixing device 30 of this embodiment will be described using FIG. 2. Here, the fixing device is required to meet shortening of a warm-up time by a quick temperature rise and recording materials of various sizes. In the case where thermal capacity of a heater of the fixing device is made small in order to shorten the warm-up time, a heater provided with only a heat generating element with a length in conformity to a width of a recording material with a maximum size would be considered. However, in this case, a temperature becomes excessively high in a non-passing region where the recording material does not pass through a fixing nip relative to a passing region where the recording material passes through the fixing nip. For this reason, conventionally, it has been requirement that a temperature rise in the non-passing region is suppressed. In this embodiment, by causing a heater 600 of the fixing device 30 to have a constitution including a plurality of heat generating elements corresponding to a plurality of sizes of the recording materials, the temperature rise in the non-passing region is suppressed.

Figure 2:
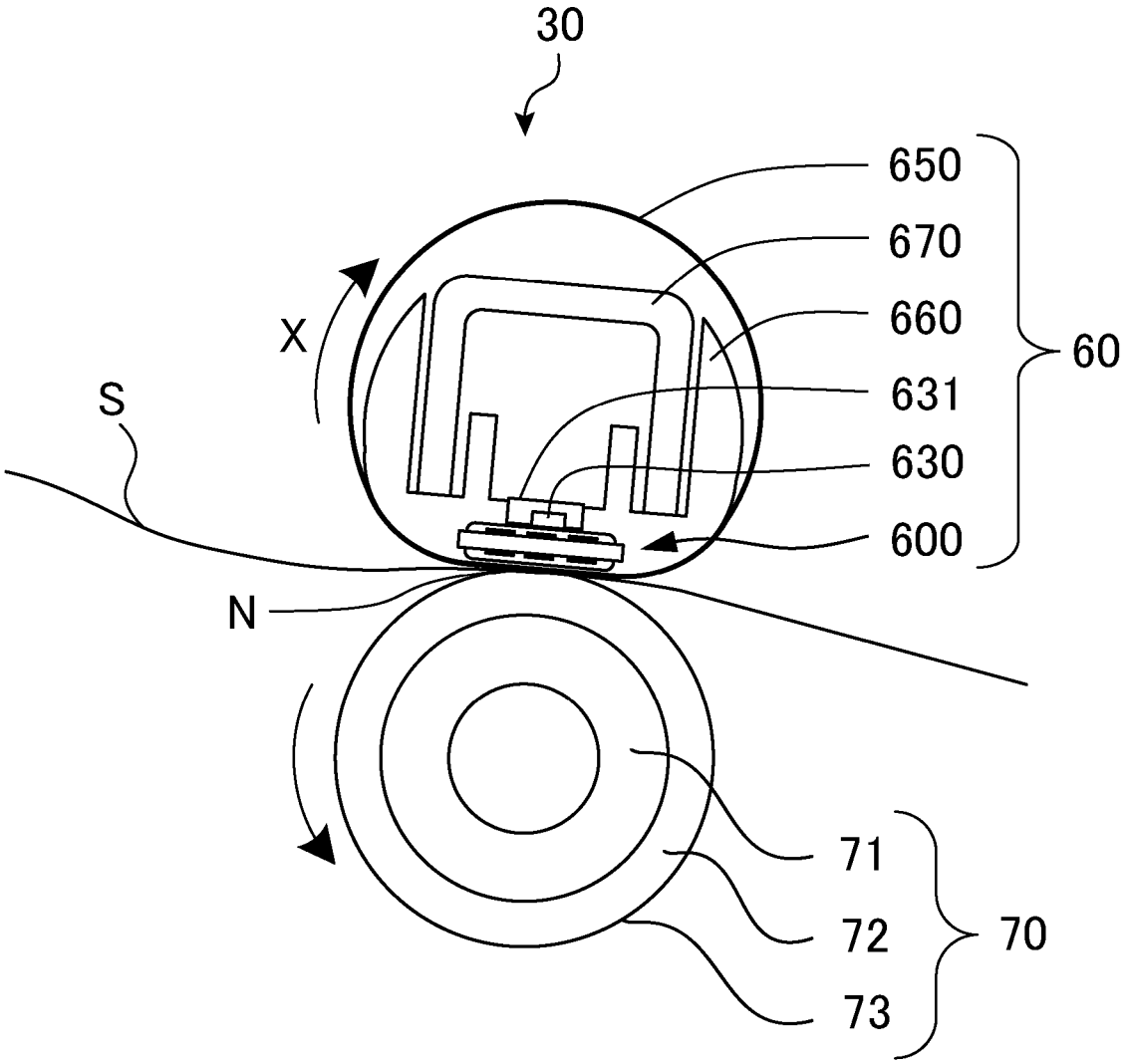
FIG. 2 is a schematic structural sectional view of a fixing device according to the first embodiment.

As shown in FIG. 2, the fixing device 30 of this embodiment includes a fixing belt unit 60 and a pressing roller 70, and is provided so as to mountable in and dismountable from the apparatus main assembly of the image forming apparatus 100 (see FIG. 1). The fixing belt unit 60 includes a fixing belt 650 and a heater 600 and the fixing belt 650 is heated by the heater 600 although described later specifically.

The pressing roller 70 as a nip forming member and a rotatable member is rotatably supported by the apparatus main assembly. Further, the pressing roller 70 is disposed so that a longitudinal direction thereof is parallel to the fixing belt unit 60, and is provided so as to be pressed by the fixing belt unit 60 in contact with an outer peripheral surface of the fixing belt 650. The pressing roller 70 includes, for example, an about 3 μm-thick elastic layer 72 of a silicone rubber or the like on an outer periphery of a core metal 71 made of metal (for example, stainless steel) and an about 40 μm-thick parting-layer 73 comprising fluorine-containing resin such as PTFE, PFA, or FEP on an outer periphery of the elastic layer 72. The pressing roller 70 is rotatably supported by a device frame by being shaft-supported and held at both end portions of the core metal 71 rotatably between side plates of an unshown device frame.

Between the fixing belt 650 and the pressing roller 70, a fixing nip N is formed as described later. Therefore, when the pressing roller 70 is rotated by an unshown motor, by a frictional force generated in this fixing nip N, a rotational force of the pressing roller 70 is transmitted to the fixing belt 650. Thus, the fixing belt 650 is rotationally driven by the pressing roller 70 (so-called, a pressing roller driving type). The recording material S is nipped and fed in the fixing nip N formed by these rotating pressing roller 70 and fixing belt 650.

In the fixing device 30, energization to the heater 600 is carried out when the pressing roller 70 is rotationally driven and the cylindrical fixing belt 650 is in a follower rotation state therewith. Then, when a temperature of the heater 600 is in a state in which the temperature is rising temperature-controlled to a target temperature, the recording material S carrying thereon the unfixed toner image is guided and introduced along an unshown inlet guide into the fixing nip N.

In the fixing nip N, a toner image carrying surface side of the recording material S hermetically contacts an outer surface of the fixing belt 650, so that the recording material S moves together with the fixing belt 650. In a nip-feeding process of the recording material S in the fixing nip N, heat from the heater 600 is imparted to the recording material S via the fixing belt 650, so that the unfixed toner image is melted and fixed on the recording material S. The recording material S passed through the fixing nip N is separated and discharged from the fixing belt 650.

[Fixing Belt Unit]

Next a constitution of the fixing belt unit 60 will be specifically described. The fixing belt unit 60 is provided in the apparatus main assembly so as to be movable toward the pressing roller 70 side. The fixing belt unit 60 includes the fixing belt 650, a heater holder 660, a stay 670, and the heater 600 which are non-rotationally disposed inside the fixing belt 650.

[Fixing Belt]

The fixing belt (fixing film) 650 is formed in an endless shape (cylindrical shape) and has flexibility, and in the case of this embodiment, is a thin film-like belt. Such a fixing belt is one in which an elastic layer is formed on a base material, and further, an outermost surface layer is formed on the elastic layer. The base material is one prepared by forming, for example, stainless steel in a cylindrical shape in a thickness of 30 μm. The elastic layer is, for example, an about 300 μm-thickness silicone rubber layer (elastic layer), and is formed on the base material by an appropriate method such as a ring coating method. The outermost surface layer is, for example, a 20 μm-thick PFA resin tube on which the elastic layer is coated. Further, onto an inner peripheral surface of the fixing belt 650, grease as a lubricant is applied. This is because a sliding property between the inner peripheral surface of the fixing belt 650 and the heater holder is improved. Incidentally, as the base material of the fixing belt 650, other than the stainless steel, a nickel-based metal material, a heat-resistant resin such as polyimide, and the like may also be used.

The fixing belt 650 is capable of being mounted in and dismounted from the heater holder 660 described later, and is supported so as to be rotatable and be restricted in movement of a widthwise direction by unshown flange portion disposed at both end portions with respect to the widthwise direction (longitudinal direction) crossing the rotational direction of the fixing belt 650. That is, the flange portions include cylindrical portions which are fitted into end portions of the fixing belt 650 with respect to the widthwise direction and which rotatably supports the end portions of the fixing belt 650 with respect to the widthwise direction, and include contact portions contactable to end edges of the fixing belt 650 with respect to the widthwise direction. The cylindrical portions guide rotation of the fixing belt 650 while holding the end portions of the fixing belt 650 with respect to the widthwise direction in a cylindrical state from the inside of the fixing belt 650.

Here, the pressing roller 70 and the fixing belt 650 are disposed in a state in which these roller and belt are slightly deviated from a parallel state due to a mounting error of the pressing roller 70 and the fixing belt unit 60, or the like in some cases. In that case, the fixing belt 650 is capable of shifting and moving in the widthwise direction while rotating in an arrow X direction in the figure by the rotating pressing roller 70. For this reason, when the fixing belt 650 shifts and moves in the widthwise direction, the contact portion of the flange portion receives the end portion of the fixing belt 650 with respect to the widthwise direction and restricts movement of the fixing belt 650 in the widthwise direction. Incidentally, the heater holder 660 and the stay 670 are mounted to the flanges, and are non-rotationally disposed inside the fixing belt 650. The flange portions are held by unshown side plates or the like of the fixing belt unit 60.

[Stay]

The stay 670 is a rigid member (metal plate) which extends along the fixing belt 650 in the widthwise direction and which is made of, for example, metal, and herein, is formed in a substantially U-character shape in cross-sectional surface so as to be provided with an opening on the heater holder 660 side. This stay 670 reinforces the heater holder 660 so as not to be deformed, by a pressing force acting between the fixing belt unit 60 and the pressing roller 70. To the stay 670, the above-described flange portions are fixed at both end portions of the stay 670 with respect to the widthwise direction. The flange portions at the both end portions are pressed toward the pressing roller 70 at a predetermined pressing force (for example, 90-320 N) by an unshown pressing mechanism. By this, the pressing force acts on the fixing belt 650 from the flange portions via the stay 670 and the heater holder 660, so that the fixing belt 650 and the pressing roller 70 are press-contacted by a desired press-contact force. By press-contacting the fixing belt 650 and the pressing roller 70 to each other, between the fixing belt 650 and the pressing roller 70, the fixing nip N having a predetermined width with respect to the feeding direction of the recording material S is formed. The recording material S on which the toner image is formed is pressed and fed at the fixing nip N. Incidentally, the stay 670 may also be formed in a shape such that the stay 670 slides on the inner peripheral surface of the fixing belt 650.

[Heater Holder]

The heater holder 660 is, for example, formed by a member made of a resin, high in heat-resistant property and high in heat-insulating property, such as a liquid crystal polymer resin, and performs a function of not only holding the heater 600 but also guiding the fixing belt 650. On the heater holder 660, an engaging groove capable of engaging and holding the heater 600 is formed in a shape extending along the widthwise direction, at a surface on an opposite side (fixing nip N side) to a surface on the stay 670 side. The heater 600 held by the heater holder 660 is capable of heating the rotating fixing belt 650 of which surface is contacted to the inner peripheral surface of the fixing belt 650. By this, when the recording material S is nipped and fed by the fixing nip N, heat generated by the heater 600 is conducted to the recording material S, so that the unfixed toner image is heated and melted, and is fixed on the recording material S. The heater 600 is controlled by a heater control circuit 200 described later. These heater 600 and heater control circuit 200 will be specifically described later (see FIG. 3 described later).

[Heater]

Figure 4:
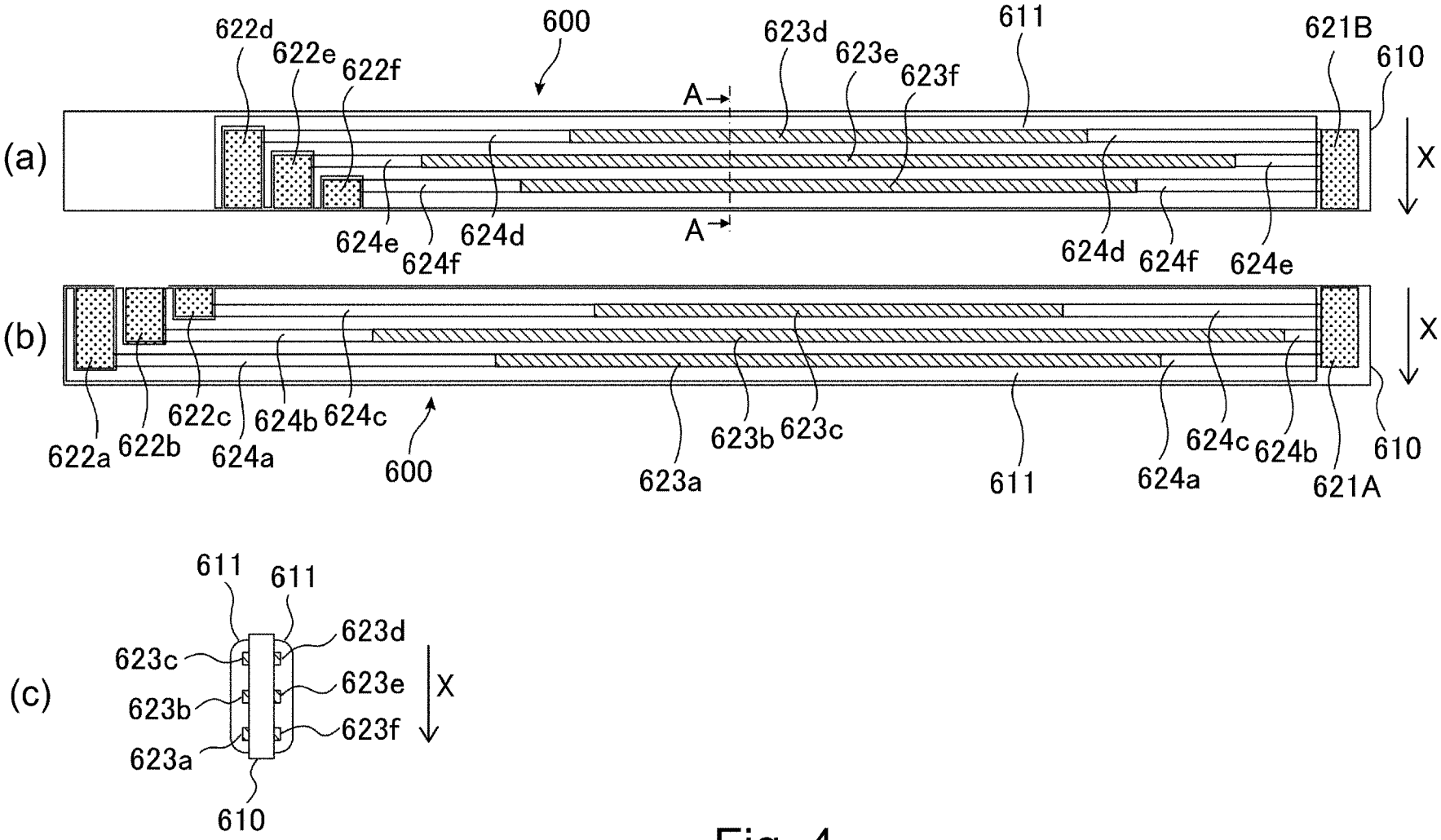
In FIG. 4, part (a) is a schematic structural top (plan) view of the heater according to the first embodiment on a back surface side, part (b) is similarly a schematic structural top view of the heater on a front surface side, and part (c) is an A-A sectional view of part (a).

The heater 600 as a heating member includes a substrate 610, a plurality of heat generating elements 623*a*-623*f*, and a protective glass 611, which have an insulating property, a heat-resistant property, and a low thermal capacity with respect to the widthwise direction (which is also a direction perpendicular to a direction in which the recording material is fed in the fixing nip N9 as a longitudinal direction (parts (a) to (c) of FIG. 4). As a constitution in which three or more plurality of heat generating elements are provided on at least one surface, in this embodiment, the heat generating elements 623*a*-623*f* are provided by three pieces) on each of a front surface (side) and a back surface (side). The protective glass 611 is provided on the front surface and the back surface of the substrate 610 in order to ensure the insulating property. Further, as described above, the heater 600 is fixedly supported by the heater holder 660. Such a heater 600 is a low thermal capacitance ceramic heater capable of rising in temperature with an abrupt rising characteristic by electric power supply to either one of the heat generating elements 623*a*-623*f*.

On the front surface side of the heater 600 contacting the inner peripheral surface of the fixing belt 650, as a sliding (friction) layer, for example, a polyimide layer of about 10 μm in thickness is formed. By forming the polyimide layer on the heater 600, a sliding (frictional) resistance between the fixing belt 650 and the heater 600 can be reduced, and thus it is possible to realize a reduction of a driving torque for rotating the fixing belt 650 and a reduction of abrasion by sliding of the fixing belt 650. Incidentally, in the case where as a base material of the fixing belt 650, a heat-resistant resin such as polyimide is used, the polyimide layer as a sliding layer of the heater 600 may also be omitted. A specific constitution of the heater 600 will be described later.

[Temperature Sensor]

In order to control the temperature of the fixing belt 650 in this embodiment, a temperature sensor 630 for detecting a temperature of the heater 600 is provided. In this embodiment, for example, a contact-type temperature sensor 630 such as a thermistor sensor is employed. However, the temperature sensor 630 may also be of a non-contact type. The temperature sensor 630 is disposed inside the heater holder 660 so that a detecting portion contacts the back surface of the heater 600 on a side opposite from the fixing belt 650. Further, the temperature sensor is disposed singly at a central portion of the heater 600 with respect to the widthwise direction and the longitudinal direction, and detects the temperature of the heater 600 in the neighborhood of a center. Further, control for adjusting the temperature of the plurality of heat generating elements provided on the heater 600 is carried out by a common temperature sensor 630. Incidentally, the number of the temperature sensor 630 is not limited to one, but a plurality of temperature sensors 630 may also be disposed over the widthwise direction of the fixing belt 650. Further, in the case where the plurality of temperature sensors 630 exist, the temperature sensors 630 may also be shifted and disposed in the rotational direction of the fixing belt 650.

[Thermostat]

Further, in this embodiment, a thermostat 631 is provided so as to cut off the electric power supply to the heater 600 when the temperature of the heater 600 exceeds a predetermined temperature. The thermostat 631 is disposed on the back surface side of the heater 600. The thermostat 631 is a switch such that the electric power supply is cut off by opening a contact through a reversal of bimetal when, for example, the temperature becomes a predetermined temperature or more and that the electric power supply is started by closing the contact through returning of the bimetal to a state before the reversal when the temperature becomes lower than the predetermined temperature.

[Heater Control]

Next, control of the heater 600 will be described using FIG. 3. In this embodiment, a heater unit 680 is constituted by the heater 600, the temperature sensor 630, and the thermostat 631. The heater unit 680 is controlled by the heater control circuit 200. The heater control circuit (driver circuit) 200 is one for adjusting a heat generating state including ON/OFF of energization to the heater 600 under control of the controller 300. The heater 600 is provided so as to be connectable to the heater control circuit 200.

The controller 300 carries out control of entirety of the image forming apparatus 100 in addition to the control of the heater 600. Such a controller 300 includes a CPU (Central Processing Unit) 301, a ROM (Read Only Memory), a RAM (Random Access Memory), and the like. The CPU 301 carries out control of respective portions while reading a program corresponding to a control procedure stored in the ROM. Further, in the RAM, data for an operation and input data are stored, and the CPU 301 carries out the control by making reference to the data stored in the RAM on the basis of the above-described program or the like. Incidentally, the controller 300 may also be one such as a micon prepared exclusively for control of the heater 600. In this case, the controller 300 may also be provided in the fixing device 30.

In the case of this embodiment, the controller 300 acquires a detection result of the temperature sensor 630, and is capable of controlling the heater control circuit 200 on the basis of the acquired detection result so that the temperature of the heater 600 is maintained at a target temperature (for example, about 200° C.). A heat generating state of the heater 600 is changed depending on control of the electric power supply to the heater 600 by the heater control circuit 200.

As regards electric power for generating the heater 600, electric power generated by a commercial power (voltage) source 400 is supplied via the heater control circuit 200. A DC voltage source 410 is a switching voltage source (ACDC voltage source) for supplying the electric power to each of loads on a secondary side in the image forming apparatus. The DC voltage source 410 generates DC voltages "5V" and "24V" on the secondary side from an AC voltage "100V" outputted by the commercial voltage source 410. The DC voltage "5V" generated by the DC voltage source 410 is used for driving the controller 300 and the like, the DC voltage "24V" is used for driving triac driving circuits 321*a*-231*f* and the like. Incidentally, the temperature sensor 630 has a property such that a resistance value of the temperature sensor 630 lowers as the temperature becomes higher, so that the temperature sensor 630 is capable of detecting the temperature at a component voltage "Vt1" for a resistance R with respect to a reference voltage "5V" of the controller 300.

The thermostat 631 is disposed in the neighborhood of a center of the heater 600, and is maintained in an open state through separation of an inside contact when the temperature reaches a predetermined temperature. Further, the thermostat 631 is connected between the heater control circuit 200 and the heater 600.

The heater control circuit 200 is a circuit which is connected to the commercial voltage source 400 and which supplies electric power to the DC voltage source 410 and the heater 600 in the fixing device 30, and an amount of electric power supply to the heater 600 is adjusted by a conduction ratio of the triacs 201*a*-201*f*. Such a heater control circuit 200 includes a relay circuit 210, a zero-cross detecting circuit 220, a plurality (6 pieces in this embodiment) of triac driving circuits 231*a*-231*f*.

The relay circuit 210 is a circuit for cutting off the electric power supply to the fixing provided 30 in the case where the voltage outputted from the commercial power source 400 is an abnormal value, and is connected to the commercial voltage source 400. The relay circuit 210 is turned on and turned off in accordance with a relay ON signal (RL-ON) sent from the CPU 301 of the controller 300.

The zero-cross detecting circuit 220 is a circuit which detects a zero-cross timing of the AC voltage outputted from the commercial power source 400 and which outputs a zero-cross signal ZX. The outputted zero-cross signal EX is inputted to the controller 300 and is used for changing a conduction ratio of the triacs 201*a*-201*f* described later.

In order to carry out adjusting control of ON/OFF control of the electric power supply to the heater 600 and of the electric power supply amount, in this embodiment, the plurality of triacs 201*a*-201*f* are used. On the heater 600, three heat generating elements 623*a*-623*c* and three heat generating elements 623*d*-623*f* are provided on a front surface (first surface) of the substrate 610 on a side where the heater 600 contacts the inner peripheral surface of the fixing belt 650 and on a back surface (second surface) of the substrate 610 on a side opposite from the front surface, respectively. In FIG. 3, the heat generating elements 623*a*-

623*c* on the front surface (a lower side of a broken line in the figure) and the heat generating elements 623*d*-623*f* on the back surface (an upper side of the broken line in the figure) are schematically shown by being vertically arranged. Details of the heater 600 will be described later.

In this embodiment, in order to independently operate these six heat generating elements 623*a*-623*f*, six triacs 201*a*-201*f* are provided. First, as regards the heat generating elements 623*a*-623*c* provided on the front surface of the substrate 610, the triac 201*a* is connected to the heat generating element 623*a*, the triac 201*b* is connected to the heat generating element 623*b*, and the triac 201*c* is connected to the heat generating element 623*c*, respectively. Further, as regards the heat generating elements 623*d*-623*f*, the triac 201*d* is connected to the heat generating element 623*d*, the triac 201*e* is connected to the heat generating element 623*e*, and the triac 201*f* is connected to the heat generating element 623*f*, respectively. These triacs 201*a*-201*f* are connected to the heat generating elements 623*a*-623*f* on one end side and are connected to the commercial power source 400 via the zero-cross detecting circuit 220 and the relay circuit 210 on the other side opposite from the one side with respect to the widthwise direction.

These triacs 201*a*-201*f* are connected to the triac driving circuits 231*a*-231*f*. The triac driving circuits 231*a*-231*f* are capable of independently turning on and turning off the triacs 201*a*-201*f* in accordance with a heater ON signal (H-ON) appropriately sent from the CPU 301 of the controller 300. When the triacs 201*a*-201*f* are turned on, electric power supply to the heat generating elements 623*a*-623*f* connected to the triacs 201*a*-201*f* which are turned on, so that the heat generating elements 623*a*-623*f* generate heat.

The triac driving circuits 231*a*-231*f* are capable of changing the conduction ratio of the triacs 201*a*-201*f* in accordance with a timing change of the heater ON signal (H-ON) sent from the CPU 301 of the controller 300. By changing the conduction ratio of the triacs 201*a*-201*f*, the electric power supply amount to the heat generating elements 623*a*-623*f* is changed. For example, when the conduction ratio of the triacs 201*a*-201*f* is made high, the electric power supply amount to the heat generating elements 623*a*-623*f* becomes large, so that a heat generation temperature of the heat generating elements 623*a*-623*f* is capable of being made high. On the other hand, when the conduction ratio of the triac 201*a*-201*f* is made low, the electric power supply amount to the heat generating elements 623*d*-623*f* becomes small, so that the heat generation temperature of the heat generating elements 623*d*-623*f* is capable of being made low.

The CPU 301 controls the conduction ratio of the triacs 201*a*-201*f* so that a center temperature of the heater 600 becomes a target temperature (about +200° C.) by being monitored at the above-described voltage Vt1. Specifically, the CPU 301 changes a timing of the heater ON signal H-ON to the triac driving circuits 231*a*-231*f*.

Figure 3:
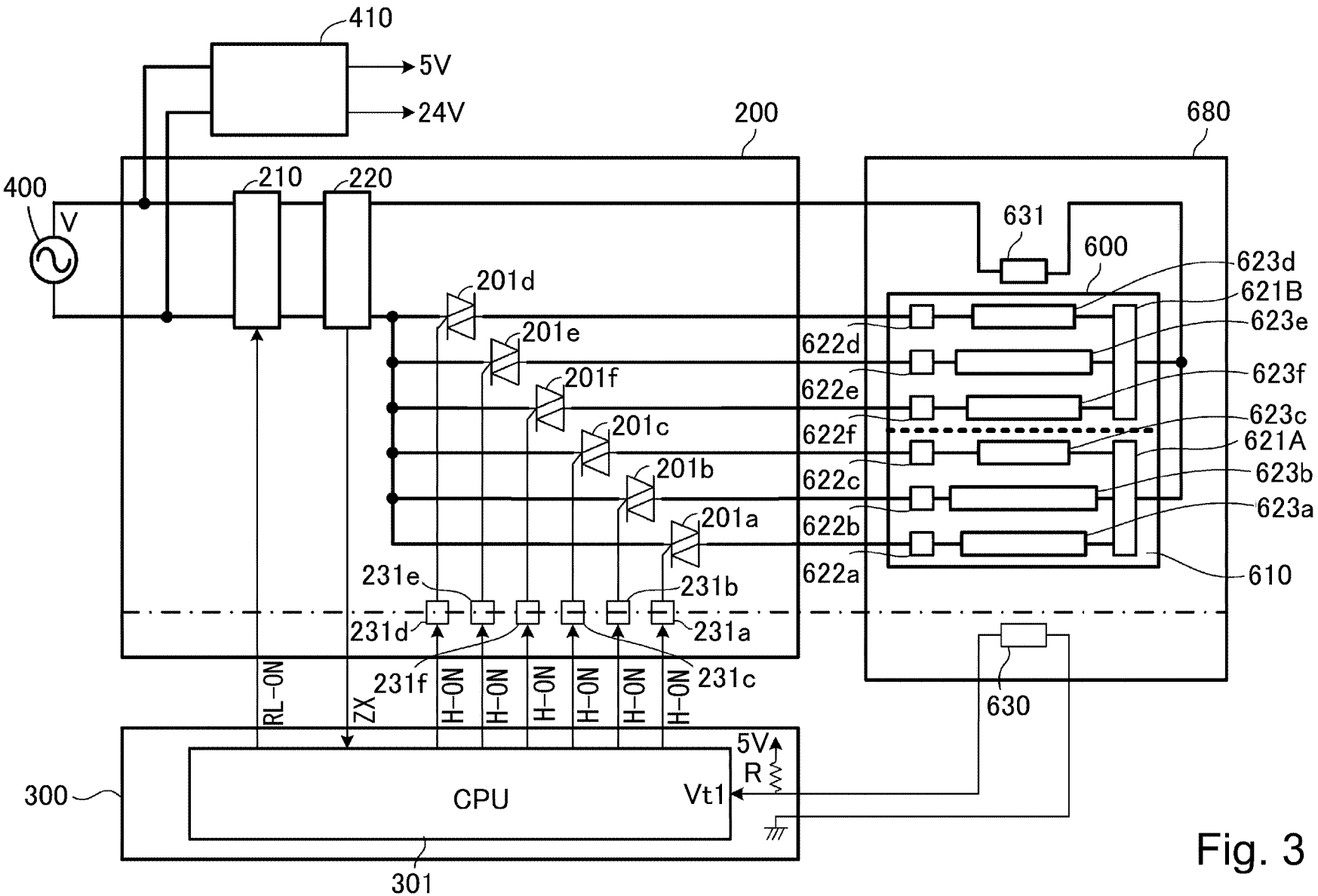
FIG. 3 is a structural view of a heater and a heater control circuit according to the embodiment 1.

In a control constitution of FIG. 3, the heat generating element to which electric power is supplied depending on a size of a selected recording material. For example, in the case where an A4-size sheet is selected as the recording material, the CPU 301 adjusts the amount of the electric power supply to the heat generating element 623*b* by changing the conduction ratio of the triac 201*b* with the H-ON signal, and thus controls the temperature at the target temperature.

Further, in the case where A5 lateral feeding (A5R) is selected, the CPU 301 adjusts the amount of the electric power supply to the heat generating element 623*c* by changing the conduction ratio of the triac 201*b* with the H-ON signal, and thus controls the temperature at the target temperature. Also, as regards another sheet size, a heat generating element corresponding to the sheet size is selected similarly, and temperature control is carried out by controlling the amount of the electric power supply to the heat generating element.

Further, when a center temperature of the heater 600 becomes high so as to be a predetermined value or more, the CPU 301 cuts off the electric power supply to the heater 600 by turning off the relay ON signal RL-ON and respective triac ON signals H-ON.

[Details of Heater]

Next, details of the heater 600 of this embodiment will be described using part (a) of FIG. 4 to part (c) of FIG. 4 while making reference to FIG. 3. Part (a) of FIG. 4 shows a back surface side of the heater 600, part (b) of FIG. 4 shows a front surface side of the heater 600, and part (c) of FIG. 4 shows an A-A cross-sectional view of the heater 600. Incidentally, in part (a) of FIG. 4 to part (c) of FIG. 4, arrows X in the figures indicate a rotational direction of the fixing belt 650 in the fixing nip N, i.e., a recording material feeding direction (see FIG. 2).

The heater 600 as a heating member includes the substrate 610 and the plurality of heat generating elements 623*a*-623*f* which are provided on both surfaces of the substrate 610 and which generate heat by energization, and heats the fixing belt 650 by being contacted to the inner peripheral surface of the fixing belt 650. The substrate 610 has an insulating property and a heat-resistant property, and is formed by using a material with a further high thermo-conductive property, for example, ceramic such as alumina or aluminum nitride.

The plurality of heat generating elements 623*a*-623*f* are different from each other in length with respect to the widthwise direction crossing the rotational direction of the fixing belt 650 in other to meet recording materials of the plurality of sizes. These respective heat generating elements 623*a*-623*f* are provided substantially parallel to the widthwise direction, respectively. Further, the heat generating elements 623*a*-623*f* are disposed with intervals with each other with respect to the recording material feeding direction on the respective surfaces thereof. Further, on the front surface (first surface) of the substrate 610 which is a side where the heater 600 contacts the inner peripheral surface of the fixing belt 650, at least three pieces of heat generating elements are provided. In this embodiment, three heat generating elements 623*a*-623*c* are provided on the front surface of the substrate 610. On the other hand, on the back surface (second surface) of the substrate 610 which is a side opposite from the front surface of the substrate 610, at least one heat generating element is provided. In this embodiment, three heat generating elements 623*d*-623*f* which are the same in number as those on the front surface are provided on the back surface of the substrate 610.

As shown in part (a) of FIG. 4, on the back surface of the substrate 610, the three heat generating elements 623*d*-623*f* different from each other in length with respect to the widthwise direction are printed and baked by using silver/palladium (Ag/Pd). Further, these heat generating elements 623*d*-623*f* are connected to three independent electrodes 622*d*-622*f*, respectively, on one end side with respect to the widthwise direction by electroconductive member patterns 624*d*-624*f* formed of silver (Ag) or the like, and are connected to a single common electrode 621B on the other end side by the electroconductive member patterns 624*d*-624*f*. The three independent electrodes 622*d*-622*f* are connected to the above-described triacs 201*d*-201*f*, respectively (see FIG. 3). On the other hand, the common electrode 621B is connected to the commercial power source 400 via the above-described thermostat 631, and the zero-cross detecting circuit 220 and the relay circuit 210 of the heater control circuit 200 (see FIG. 3). Incidentally, these heat generating elements 623*d*-623*f* and electroconductive member patterns 624*d*-624*f* are, as shown in part (c) of FIG. 4, covered with the protective glass 611 of, for example, 60-90 μm in thickness.

As shown in part (b) of FIG. 4, also on the front surface of the substrate 610, similarly as the back surface, the three heat generating elements 623*a*-623*c* different from each other in length with respect to the widthwise direction are printed and baked by using silver/palladium (Ag/Pd). Further, these heat generating elements 623*a*-623*c* are connected to three independent electrodes 622*a*-622*e*, respectively, on one end side with respect to the widthwise direction by electroconductive member patterns 624*a*-624*c* formed of silver (Ag) or the like, and are connected to a single common electrode 621A on the other end side by the electroconductive member patterns 624*a*-624*c*. The three independent electrodes 622*a*-622*c* are connected to the above-described triacs 201*a*-201*c*, respectively (see FIG. 3). On the other hand, the common electrode 621A is connected to the commercial power source 400 via the above-described thermostat 631, and the zero-cross detecting circuit 220 and the relay circuit 210 of the heater control circuit 200 (see FIG. 3). Incidentally, these heat generating elements 623*a*-623*c* and electroconductive member patterns 624*a*-624*c* on the front surface are, similarly as the back surface, as shown in part (c) of FIG. 4, covered with the protective glass 611 of, for example, 60-90 μm in thickness.

Incidentally, in the case of this embodiment, the common electrodes 621A and 621B are formed at the substantially same position with respect to the widthwise direction on both surfaces of the substrate 610. On the other hand, the independent electrodes 622*a*-622*c* and the independent electrodes 622*d*-622*f* are formed at different positions with respect to the widthwise direction on both surfaces of the substrate 610. However, a positional relationship between the common electrodes 621A and 621B and a positional relationship between the independent electrodes 622*a*-622*c* and the independent electrodes 622*d*-622*d* are not limited to these.

[Arrangement of Respective Heat Generating Elements]

Next, an arrangement of the plurality of heat generating elements 623*a*-623*f* will be described using part (a) of FIG. 4 to part (c) of FIG. 4 will be described. As regards the heater 600 of this embodiment, of the plurality of heat generating elements 623*a*-623*f*, the heat generating element 623*b* longest in length with respect to the widthwise direction is provided on the front surface of the substrate 610. Further, the three heat generating elements 623*a*-623*c* provided on the front surface are the heat generating element 623*b* (first heat generating element), the heat generating element 623*a* (second heat generating element), and the heat generating element 623*c* (third heat generating element) in the order from the heat generating element with a longer length with respect to the widthwise direction. In this case, with respect to the rotational direction of the fixing belt 650, the longest heat generating element 623*b* with respect to the widthwise direction is disposed between the heat generating element 623*a* and the heat generating element 623*c*. Further, the heat generating elements 623*a*-623*c* are disposed in the order of the heat generating element 623*c*, the heat generating element 623*b*, and the heat generating element 623*a* from an upstream side to a downstream side with respect to the rotational direction of the fixing belt (from an upstream side to a downstream side with respect to a direction in which the recording material is fed in the fixing nip N, with respect to the arrow X direction).

On the other hand, on the back surface of the substrate 610, at least three heat generating elements 623*d*-623*f* are provided. In this embodiment, also on the back surface, the three heat generating elements are provided. That is, the number of the heat generating elements provided on the front surface is the same as the number of the heat generating elements provided on the back surface. Further, the three heat generating elements 623*d*-623*f* provided on the back surface are the heat generating element 623*e* (fourth heat generating element), the heat generating element 623*f* (fifth heat generating element), and the heat generating element 623*d* (sixth heat generating element) in the order from the heat generating element with a longer length with respect to the widthwise direction. In this case, with respect to the rotational direction of the fixing belt 650, the longest heat generating element 623*e* with respect to the widthwise direction is disposed between the heat generating element 623*f* and the heat generating element 623*d*. Further, the heat generating elements 623*d*-623*f* are disposed in the order of the heat generating element 623*d*, the heat generating element 623*e*, and the heat generating element 623*f* from an upstream side to a downstream side with respect to the rotational direction of the fixing belt (from an upstream side to a downstream side with respect to a direction in which the recording material is fed in the fixing nip N, with respect to the arrow X direction).

That is, in this embodiment, not only on the front surface but also on the back surface, the longest heat generating element with respect to the widthwise direction is positioned at a central portion on each of the surfaces, and in the case where the heat generating elements on sides upstream of and downstream of this heat generating element are compared with each other, the heat generating element on the downstream side is longer in length with respect to the widthwise direction than the heat generating element on the upstream side. Incidentally, lengths of the heat generating elements on each of the surfaces are the same with respect to the rotational direction of the fixing belt 650. In this embodiment, the lengths of all the heat generating elements 623*a*-623*f* with respect to the rotational direction of the fixing belt 650 are the same.

Next, specific examples of the respective heat generating elements 623*a*-623*f* will be described. The six heat generating elements 623*a*-623*f* disposed on the both surfaces of the substrate 610 are different from each other in length, resistance value, and electric power in conformity with lengths of a plurality of sheets with respect to the widthwise direction. In a table 1, examples of the heat generating elements 623*a*-623*f* in the case for a commercial power source of 100 V are shown. Incidentally, a "heat generating element length" in the table 1 is a length of the heat generating element with respect to the widthwise direction.

TABLE 1

| SURFACE | HEAT GENERATING ELEMENT | CORRESPONDING SHEET SIZE | SHEET WIDTH [mm] | HEAT GENERATING ELEMENT LENGTH [mm] | HEAT GENERATING ELEMENT RESISTANCE VALUE [Ω] | HEAT GENERATING ELEMENT ELECTRIC POWER [W] | TOTAL ELECTRIC POWER FOR EACH SURFACE [W] |
|---|---|---|---|---|---|---|---|
| FRONT | 623b | A3/A4 | 297 | 318 | 8.3 | 1205 | 2894 |
| | 623a | B4/B5 | 257 | 278 | 9.5 | 1053 | |
| | 623c | A5R | 148 | 169 | 15.7 | 637 | |
| BACK | 623e | LTR | 279.4 | 300.4 | 8.8 | 1136 | 2775 |
| | 623f | A5R/A5 | 210 | 231 | 11.5 | 870 | |
| | 623d | B5R | 182 | 203 | 13 | 769 | |

Here, in the heater 600, heat generated by the heat generating elements on the back surface side of the substrate 610 is conducted to the fixing belt 650 via the substrate 610. For that reason, compared with the heat generating elements disposed on the front surface, the heat generating elements disposed on the back surface side are lowered in heat (thermal) conduction efficiency toward the fixing belt 650. In order to suppress a lowering in heat conduction efficiency toward the fixing belt 650, it is desirable that the heat generating elements are disposed on the front surface of the substrate 610. However, in a constitution including the plurality of heat generating elements different in length, when all the heat generating elements are disposed on the front surface, correspondingly to that many heat generating elements are disposed, a length of the heater 600 with respect to the recording material feeding direction becomes long. Then, a pressing force for forming the fixing nip N has to be made large. An increase in pressing force causes an increase in torque for rotationally driving the pressing roller 70 and is not preferable. Accordingly, by disposing the heat generating elements on each of the both surfaces of the substrate 610, a heater including many heat generating elements which are short in length with respect to the recording material feeding direction and which are for meeting various sizes is obtained.

In the case of this embodiment, when a length (sheet width) of the recording material S with respect to the widthwise direction is long, lengths (heat generating element lengths) of the heat generating elements 523*a*-623*f* with respect to the widthwise direction are also formed long. In the case of the examples shown in the table 1, the lengths of the heat generating elements 623*a*-623*f* with respect to the widthwise direction are formed about 21 mm longer than lengths of corresponding recording materials with respect to the widthwise direction, respectively. This is because the recording material S is somewhat displaced in the widthwise direction and enters the fixing nip N when the recording material S is fed to the fixing nip N (see FIG. 2) and a heating region of the fixing belt 650 is ensured so that the recording material S can be properly heated even in such a case.

Further, as can be understood from the table 1, the heat generating elements 623*a*-623*f* become larger in maximum electric power with a longer length with respect to the widthwise direction thereof. Further, the heat generating elements 623*a*-623*f* change in heat generation temperature by an amount of supplied electric power, and thus are capable of generating heat at high temperatures with a larger maximum electric power amount. Accordingly, the heat generating elements 623*a*-623*f* are capable of generating heat at high temperatures with a longer length with respect to the widthwise direction.

In the heater 600 of this embodiment, the heat generating element 623*f* largest in maximum electric power amount and the heat generating element 623*e* secondarily largest in maximum electric power amount are provided on different surfaces of the substrate 610, respectively. The heat generating element 623*b* largest in maximum electric power amount, i.e., the heat generating element 623*b* longest in length with respect to the widthwise direction is provided on the front surface. Although described later, of the three heat generating elements 623*a*-623*c* provided on the front surface of the substrate 610, the heat generating element 623*b* largest in maximum electric power amount is provided at a center with respect to the rotational direction of the fixing belt 650. On the other hand, the heat generating element 623*e* secondarily largest in maximum electric power amount, i.e., the heat generating element 623*e* secondarily longest in length with respect to the widthwise direction is provided on the back surface of the substrate 610. Further, of the three heat generating elements 623*d*-623*f* disposed on the back surface of the substrate 610, the heat generating element 623*e* secondarily largest in maximum electric power amount is provided at a center with respect to the rotational direction (X direction in the figure) of the fixing belt 650. Thus, by positioning the heat generating element, largest in maximum electric power amount (longest in length) among the three or more heat generating elements provided on one surface of the substrate, so as to be sandwiched by other heat generating elements, it is possible to reduce the distortion of the substrate due to the heat when the heat generating element largest in maximum electric power amount is caused to generate heat.

By doing so, for example, even when a triac 701*b* is out of order and the heat generating element 623*b* largest in maximum electric power amount is in a state in which the heat generating element 623*b* always heat, a temperature difference of the substrate 610 between the front surface and the back surface can be suppressed to "2258 W (1205+1053)" at the maximum. In the case of this embodiment, it is confirmed by an experiment by the present inventors that when the temperature difference of the substrate 610 between the front surface and the back surface is suppress to "3000 W" or less, the substrate 610 does not deform.

In this embodiment, both a total value of respective maximum electric power amounts of the heat generating elements 623*a*-623*c* provided on the front surface of the substrate 610 and a total value of respective maximum electric power amounts of the heat generating elements 623*d*-623*f* provided on the back surface of the substrate 610 are suppressed to "3000 W" or less. Further, a difference between the total value of the respective maximum electric power amounts of the heat generating elements 623*a*-623*c* provided on the front surface of the substrate 610 and the total value of the respective maximum electric power amounts of the heat generating elements 623*d*-623*f* provided on the back surface of the substrate 610 may preferably be small as can as possible. In this embodiment, the heat generating elements were disposed on the front surface and the back surface, respectively, so that a combination such that a difference between the maximum electric power amounts of the heat generating elements disposed on the front surface of the substrate 610 and the maximum electric power amounts of the heat generating elements disposed on the back surface of the substrate 610 becomes minimum is formed.

Further, in the heater 600 of this embodiment, of the plurality of heat generating elements 623*a*-623*f*, the heat generating element 623*b* largest in maximum electric power amount and the heat generating element 623*c* smallest in maximum electric power amount may preferably be disposed on the front surface of the substrate 610 in combination. In other words, of the plurality of heat generating elements 623*a*-623*f*, the heat generating element 623*b* longest in length with respect to the widthwise direction and the heat generating element 623*c* shortest in length with respect to the widthwise direction are disposed on the same surface of the substrate 610. Further, the shortest heat generating element 623*c* may preferably be disposed on a side upstream of the heat generating element 623*b* disposed at a center with respect to the rotational direction (X direction in the figure) of the fixing belt 650. In other words, of the upstream side and the downstream side, on the downstream side, the heat generating element 623*a* longer in length with respect to the widthwise direction than the heat generating element 623*c* is disposed.

On the other hand, of the plurality of heat generating elements 623*a*-623*f*, the heat generating element 623*e* secondarily largest in maximum electric power amount and the heat generating element 623*d* secondarily smallest in maximum electric power amount may preferably be disposed on the back surface of the substrate 610 in combination. In other words, of the plurality of heat generating elements 623*a*-623*f*, the heat generating element 623*e* secondarily longest in length with respect to the widthwise direction and the heat generating element 623*d* secondarily shortest in length with respect to the widthwise direction are disposed on the same surface of the substrate 610. Further, the secondarily shortest heat generating element 623*d* may preferably be disposed on a side upstream of the heat generating element 623*e* disposed at a center with respect to the rotational direction of the fixing belt 650. In other words, of the upstream side and the downstream side, on the downstream side, the heat generating element 623*f* longer in length with respect to the widthwise direction than the heat generating element 623*d* is disposed.

By employing such a constitution, even if the heater control circuit 700 is out of order, the plurality of heat generating elements 623*a*-623*f* are provided by being divided between the front surface and the back surface so that a temperature difference between a front surface temperature and a back surface temperature can be suppressed to not more than a temperature of which the substrate 610 is capable of being deformed. Specifically, as shown in the above-described table 1, of the plurality of heat generating elements 623*a*-623*f*, the heat generating element 623*b* longest in length with respect to the widthwise direction and the heat generating element 623*e* secondarily longest in length with respect to the widthwise direction are divided between different surfaces of the substrate 610, respectively. Even if by dividing the heat generating elements in such a manner, the heater control circuit 700 is out of order and the plurality of heat generating elements provided on either one of the surfaces simultaneously generate heat, the temperature difference between the front and back surfaces of the substrate 610 can be suppressed to not more than a temperature difference (for example, not less than 3000 W) at which the substrate 610 is not deformed.

Figure 5:
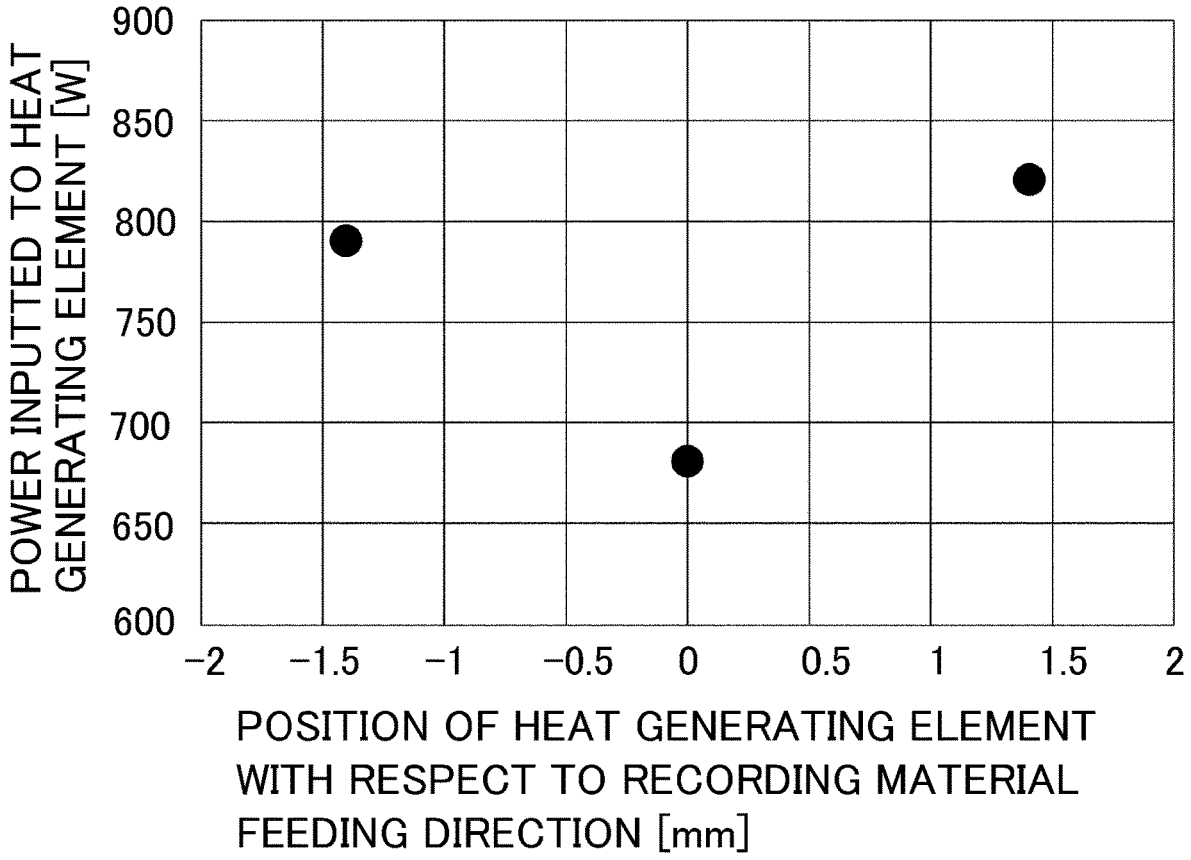
FIG. 5 is a graph showing a relationship between a position of a heat generating element at a fixing nip in a recording material feeding direction and an input electric power to the heat generating element in order to make a temperature of a fixing film a predetermined temperature.

Next, the reason why the respective heat generating elements are disposed on each of the surfaces of the substrate 610 as described above will be described using FIG. 5. FIG. 5 shows a result of an investigation of a relationship between a position of the heat generating element with respect to the recording material feeding direction in the fixing nip N when A4 sheets are continuously passed through the fixing nip N and necessary electric power inputted to the heat generating element for maintaining the temperature of the fixing belt 650 at the predetermined temperature. In FIG. 5, in order to show a difference in input electric power due to an arrangement place of the heat generating elements, the cases where electric power of each of the heat generating elements is 1205 W equivalent to the electric power of the heat generating element 623*b* and where the heat generating elements are disposed on an upstream side, a central side, and a downstream side, respectively, are shown.

The abscissa of FIG. 5 shows the position of the heat generating element with respect to the recording material feeding direction in the fixing nip N, and 0 mm corresponds to the center side, a positive direction corresponds to the upstream side, and a negative direction corresponds to the downstream side. The recording material is fed from the upstream side toward the downstream side. The ordinate shows the electric power inputted to each of the heat generating elements required for maintaining the temperature of the fixing belt 650 at the predetermined temperature.

As shown in FIG. 5, the input electric power to the center heat generating element (position of 0 mm) was 680 W, the input electric power to the downstream heat generating element (position of the negative direction on the abscissa) was 790 W, and the input electric power to the upstream heat generating element (position of the positive direction on the abscissa) was 820 W. Heating efficiency is higher as the input electric power is smaller, and therefore, the heating efficiency becomes (central)>(downstream)>(upstream). Accordingly, it is understood that the heating efficiency can be made highest by disposing the heat generating element on the central side. This would be considered because the fixing nip N can be heated substantially uniformly from the central side toward the upstream side and the downstream side.

On the other hand, as shown in FIG. 2, the recording material S enters the fixing nip N from the downstream side and passes through the fixing nip N toward the upstream side (the recording material is fed from a right(-hand) side toward a left(-hand) side of FIG. 2). For this reason, compared with the upstream side, on the downstream side, a time in which the recording material S contacts the fixing belt 650 becomes long. Accordingly, when the heat generating element is disposed on the downstream side compared with the upstream side, the heating efficiency becomes high. From the above, highest heating efficiency can be obtained by disposing the heat generating element large in electric power of the heat generating element, i.e., the longest heat generating element with respect to the widthwise direction of the heat generating element, at the position where the heating efficiency is high. This holds not only on the front surface but also on the back surface.

In this embodiment, as described above, not only on the front surface but also on the back surface, the heat generating elements are disposed so that lengths thereof with respect to the widthwise direction satisfy (central)>(downstream)>(upstream) with respect to the recording material feeding direction, i.e., the rotational direction of the fixing belt 650. For this reason, in the constitution in which the plurality of heat generating elements are provided on the both surfaces of the substrate, it becomes possible to provide the heater with excellent heating efficiency.

As described above, according to this embodiment, the longest heat generating element is provided at a position where the longest heat generating element is sandwiched between other heat generating elements, so that distortion of the substrate caused by energization to the longest can be reduced. Further, it becomes possible to provide the heater excellent in heating efficiency.

Second Embodiment

A second embodiment will be described using FIG. 6. In the above-described first embodiment, the constitution in which the three heat generating elements were provided on each of the both surfaces of the substrate was described. On the other hand, in this embodiment, four heat generating elements are provided on each of both surfaces of a substrate 710. Other constitutions and actions are similar to those in the above-described first embodiment, and therefore, the same constitution portions will be omitted from illustration and description or will be briefly described, and a portion different from the first embodiment will be principally described.

Figure 6:
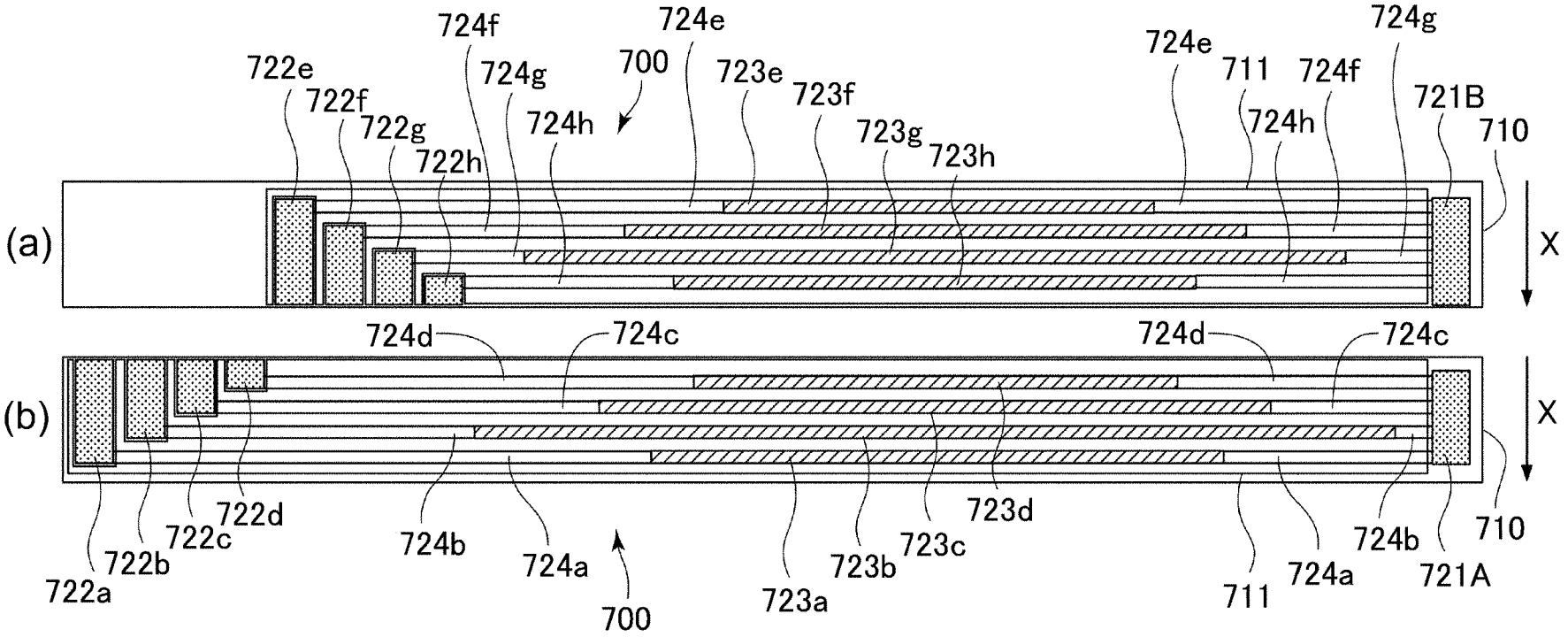
In FIG. 6, part (a) is a schematic structural top view of a heater according to a second embodiment on a back surface side, and part (b) is similarly a schematic structural top view of the heater on a front surface side.

Part (a) of FIG. 6 shows the back surface of the substrate 710 of the heater 700 in this embodiment, part (b) of FIG. 6 shows the front surface of the heater 700, and part (c) of FIG. 6 shows a B-B cross-sectional view of the heater 700. Arrows X in the figures indicate a rotational direction of the fixing belt 650 in the fixing nip N, i.e., a recording material feeding direction (see FIG. 2).

The heater 700 as a heating member includes a substrate 710 and a plurality of heat generating elements 723*a*-723*h* which are provided on both surfaces of the substrate 710 and which generate heat by energization, and heats the fixing belt 650 by being contacted to the inner peripheral surface of the fixing belt 650 (FIG. 2). The substrate 710 has an insulating property and a heat-resistant property, and is formed by using a material with a further high thermo-conductive property, for example, ceramic such as alumina or aluminum nitride.

The plurality of heat generating elements 723*a*-623*h* are different from each other in length with respect to the widthwise direction crossing the rotational direction of the fixing belt 650 in other to meet recording materials of the plurality of sizes. These respective heat generating elements 723*a*-723*h* are provided substantially parallel to the widthwise direction, respectively. Further, the heat generating elements 723*a*-723*e* are disposed with intervals with each other with respect to the recording material feeding direction on the respective surfaces thereof. Further, on the front surface (first surface) of the substrate 710 which is a side where the heater 700 contacts the inner peripheral surface of the fixing belt 650, at least three pieces of heat generating elements are provided. In this embodiment, four heat generating elements 723*a*-723*d* are provided on the front surface of the substrate 710. On the other hand, on the back surface (second surface) of the substrate 710 which is a side opposite from the front surface of the substrate 710, at least one heat generating element is provided. In the embodiment, four heat generating elements 723*e* and 723*h* which are the same in number as those on the front surface are provided on the back surface of the substrate 710.

As shown in part (a) of FIG. 6, on the back surface of the substrate 710, the four heat generating elements 723*e*-723*h* different from each other in length with respect to the widthwise direction are printed and baked by using silver/palladium (Ag/Pd). Further, these heat generating elements 723*e*-723*h* are connected to four independent electrodes 722*e*-722*h*, respectively, on one end side with respect to the widthwise direction by electroconductive member patterns 724*e*-724*h* formed of silver (Ag) or the like, and are connected to a single common electrode 721B on the other end side by the electroconductive member patterns 724*e*-724*h*. These heat generating elements 723*e*-723*h* and electroconductive member patterns 724*e*-724*h* are covered with the protective glass 711 of, for example, 60-90 μm in thickness.

As shown in part (b) of FIG. 6, also on the front surface of the substrate 710, similarly as the back surface, the four heat generating elements 723*a*-723*d* different from each other in length with respect to the widthwise direction are printed and baked by using silver/palladium (Ag/Pd). Further, these heat generating elements 723*a*-723*d* are connected to four independent electrodes 722*a*-722*d*, respectively, on one end side with respect to the widthwise direction by electroconductive member patterns 723*a*-723*d* formed of silver (Ag) or the like, and are connected to a single common electrode 721A on the other end side by the electroconductive member patterns 723*a*-723*d*. These heat generating elements 723*a*-723*d* and electroconductive member patterns 724*a*-724*d* on the front surface are, similarly as the back surface, covered with the protective glass 711 of, for example, 60-90 μm in thickness.

Incidentally, also in the case of this embodiment, the common electrodes 721A and 721B are formed at the substantially same position with respect to the widthwise direction on both surfaces of the substrate 710. On the other hand, the independent electrodes 722*a*-722*d* and the independent electrodes 722*e*-722*h* are formed at different positions with respect to the widthwise direction on both surfaces of the substrate 710. However, a positional relationship between the common electrodes 721A and 721B and a positional relationship between the independent electrodes 722*a*-722*d* and the independent electrodes 722*e*-722*h* are not limited to these. Further, a control constitution of the heater 700 in this embodiment is a constitution similar to the control constitution of FIG. 3 in the first embodiment, in which only the number of the triacs and the number of the triac driving circuits are different from those in the first embodiment depending on the number of the heat generating elements.

Next, an arrangement of the plurality of heat generating elements 723*a*-723*h* will be described. Also, as regards the heater 700 of this embodiment, of the plurality of heat generating elements 723*a*-723*h*, the heat generating element 723*b* longest in length with respect to the widthwise direction is provided on the front surface. Further, the three heat generating elements 723*a*-723*c* of the four heat generating elements 723*a*-723*d* provided on the front surface are the heat generating element 723*b* (first heat generating element), the heat generating element 723*c* (second heat generating element), and the heat generating element 723*a* (third heat generating element) in the order from the heat generating element with a longer length with respect to the widthwise direction. In this case, with respect to the rotational direction of the fixing belt 650, the longest heat generating element 723*b* with respect to the widthwise direction is disposed between the heat generating element 723*a* and the heat generating element 723*c*. Incidentally, of the four heat generating elements 723*a*-723*d*, the heat generating element 723*d* is shortest in length with respect to the widthwise direction.

Further, as regards the heat generating elements 723*a*-723*d*, in the case where the most upstream heat generating element 723*d* and the most downstream heat generating element 723*a* with respect to the rotational direction of the fixing belt (a direction in which the recording material is fed in the fixing nip N, with respect to the arrow X direction) are compared with each other, the heat generating elements 723*a* is longer in length with respect to the widthwise direction than the heat generating element 723*d*. Further, of the heat generating element 723*a*-723*d*, the two heat generating elements 723*b* and 723*c* longer in length with respect to the widthwise direction are disposed between the heat generating element 723*a* and the heat generating element 723*d* which are shorter in length with respect to the widthwise direction than these heat generating elements. That is, the heat generating elements longer in length with respect to the widthwise direction are disposed on a central side with respect to the arrow Y direction of the fixing nip N (FIG. 2). Further, as regards the two heat generating elements 723*b* and 723*c*, the heat generating element 723*b* longer in length with respect to the widthwise direction is disposed downstream of the heat generating element 723*c*. That is, the heat generating element longest in length with respect to the widthwise direction is provided on a side downstream of the center of the heater with respect to the rotational direction and is disposed between the plurality of heat generating elements. Thus, in the case where the number of the heat generating elements provided on one surface of the substrate is an even number, the longest heat generating element with respect to the widthwise direction is provided between the plurality of heat generating elements on the side downstream of the center with respect to the rotational direction. On the other hand, in the case where the number of the heat generating elements provided on one surface of the substrate is an odd number, the longest heat generating element with respect to the widthwise direction is provided at the center with respect to the rotational direction.

On the other hand, the three heat generating elements 723*f*-723*h* of the four heat generating elements 723*e*-723*h* provided on the back surface are the heat generating element 723*g* (four heat generating element), the heat generating element 723*f* (fifth heat generating element), and the heat generating element 723*h* (sixth heat generating element) in turn from the longer length with respect to the widthwise direction. In this case, with respect to the rotational direction of the fixing belt 650, the longest heat generating element 723*g* with respect to the widthwise direction is disposed between the heat generating element 723*f* and the heat generating element 723*h*. Incidentally, of the four heat generating elements 723*a*-723*h* provided on the back surface, the heat generating element 723*e* is shortest in length with respect to the widthwise direction.

Further, as regards the heat generating elements 723*e*-723*h*, in the case where the most upstream heat generating element 723*e* and the most downstream heat generating element 723*h* with respect to the rotational direction of the fixing belt (the direction in which the recording material is fed in the widthwise direction, with respect to the arrow X direction) are compared with each other, the heat generating element 723*h* is longer in length with respect to the heat generating element 723*e*. Further, of the heat generating elements 723*e*-723*h*, the two heat generating elements 723*f* and 723*g* longer in length with respect to the widthwise direction are disposed between the heat generating element 723*e* and the heat generating element 723*h* shorter in length with respect to the widthwise direction than these heat generating elements. That is, the heat generating elements longer in length with respect to the widthwise direction are disposed on the central side with respect to the arrow X direction of the fixing nip N (FIG. 2). Further, as regards the heat generating elements 723*f* and 723*g*, the heat generating element 723*g* longer in length with respect to the widthwise direction is disposed downstream of the heat generating element 723*f*.

Incidentally, lengths of the heat generating elements on each of the surfaces are the same with respect to the rotational direction of the fixing belt 650. In this embodiment, the lengths of all the heat generating elements 723*a*-723*h* with respect to the rotational direction of the fixing belt 650 are the same.

In such a case of this embodiment, the longer heat generating element with respect to the widthwise direction is disposed on the front surface on the central side of the fixing nip N, and further, in the case where a most downstream heat generating element and a most upstream heat generating element are compared with each other, the longer heat generating element with respect to the widthwise direction is disposed on the downstream side. For this reason, as described with reference to FIG. 5, in the constitution in which the plurality of heat generating elements are provided on the both surfaces of the substrate, it becomes possible to provide the heater with excellent heating efficiency.

Other Embodiments

In the above-described embodiments, the constitution in which the heat generating elements in the same number are provided on each of the both surfaces of the substrate were described, but the numbers of the heat generating elements provided on the both surfaces may also be different from each other. The present invention is applicable when a constitution in which at least three heat generating elements are provided on the front surface and at least one heat generating element is provided on the back surface is employed.

INDUSTRIAL APPLICABILITY

According to the present invention, there is provided a fixing belt unit and an image fixing device, for an electrophotographic image forming apparatus or the like, which are capable of reducing distortion of the substrate caused due to energization to the longest heat generating element.

The present invention is not restricted to the foregoing embodiments, but can be variously changed and modified without departing from the spirit and the scope of the present invention. Accordingly, the following claims are attached hereto make public the scope of the present invention.

This application claims the Conventional Priority from Japanese Patent Applications 2019-121149 filed Jun. 28, 2019 and 2019-121155 filed Jun. 28, 2019, all disclosure of which are incorporated by reference herein.

The invention claimed is:

1. A fixing belt unit comprising:

a rotatable fixing belt for fixing a toner image on a recording material; and a heating member including a substrate and a plurality of heat generating elements which are provided on both surfaces of said substrate and which generate heat by energization, and for heating said fixing belt in contact with an inner peripheral surface of said fixing belt, wherein said plurality of heat generating elements are different from each other in length with respect to a widthwise direction crossing a rotational direction of said fixing belt, wherein at least three of said heat generating elements are provided on a first surface of said substrate which is a side where said heating member contacts the inner peripheral surface of said fixing belt, and a plurality of heat generating members are provided on a second surface on an opposite side from the first surface of said substrate, and wherein with respect to the rotational direction, a longest heat generating element, in length with respect to the widthwise direction, of said heat generating elements provided on the first surface is disposed between other heat generating elements.

2. A fixing belt unit according to claim 1, wherein when three heat generating elements are provided on the first surface and are a first heat generating element, a second heat generating element, and a third heat generating element in a long order in length with respect to the widthwise direction, with respect to the rotational direction, said third heat generating element is provided on a side upstream of said first heat generating element, and said second heat generating element is provided on a side downstream of said first heat generating element.

3. A fixing belt unit according to claim 1, wherein an odd number of heat generating elements are provided on the first surface, and a longest heat generating element in length with respect to the widthwise direction is provided at a center of said heating member with respect to the rotational direction.

4. A fixing belt unit according to claim 1, wherein three of said heat generating elements are provided on the second surface of said substrate, and wherein in a case that in said heat generating elements provided on the second surface, said heat generating elements are a fourth heat generating element, a fifth heat generating element, and a sixth heat generating element in turn from a longer one in length with respect to the widthwise direction, with respect to the rotational direction, said sixth heat generating element is provided on a side upstream of said fourth heat generating element, and said fifth heat generating element is provided on a side downstream of said fourth heat generating element.

5. A fixing belt unit according to claim 1, wherein an even number of heat generating elements are provided on the first surface, and a longest heat generating element in length with respect to the widthwise direction is provided on a side downstream of a center of said heating member with respect to the rotational direction.

6. A fixing belt unit according to claim 1, wherein a number of said heat generating elements provided on the first surface is the same as a number of said heat generating elements provided on the second surface.

7. A fixing belt unit according to claim 1, wherein a longest heat generating element, in length with respect to the widthwise direction, among said plurality of heat generating elements provided on the first surface and the second surface is provided on the first surface.

8. A fixing belt unit according to claim 1, wherein each of a sum of maximum electric power values of said heat generating elements provided on the first surface and a sum of maximum electric power values of said heat generating elements provided on the second surface is 3000 W or less.

9. A fixing belt unit according to claim 1, wherein said heat generating elements are provided on each of the surfaces so that a difference between a sum of maximum electric power values of said heat generating elements provided on the first surface and a sum of maximum electric power values of said heat generating elements provided on the second surface becomes a minimum.

* * * * *